US006301761B1

(12) United States Patent
Brenner et al.

(10) Patent No.: US 6,301,761 B1
(45) Date of Patent: Oct. 16, 2001

(54) METHOD FOR PRODUCING A COMPOSITE ULTRASONIC TRANSDUCER

(75) Inventors: Axel Brenner, Bremen; Kurt Handschuh, Eckental, both of (DE)

(73) Assignee: STN Atlas Elektronik GmbH, Bremen (DE)

( * ) Notice: Subject to any disclaimer, the term of this patent is extended or adjusted under 35 U.S.C. 154(b) by 0 days.

(21) Appl. No.: 09/166,156

(22) Filed: Oct. 5, 1998

(30) Foreign Application Priority Data

Oct. 4, 1997 (DE) ..... 197 43 859

(51) Int. Cl.[7] ..... H04R 17/00
(52) U.S. Cl. ..... 29/25.35; 310/334; 310/358
(58) Field of Search ..... 29/25.35; 310/334, 310/357, 358

(56) References Cited

U.S. PATENT DOCUMENTS 2,752,662 * 7/1956 Crooks et al. ..... 29/25.35
5,539,965 7/1996 Safari et al. .
5,950,291 * 9/1999 Gentilman et al. ..... 29/25.35

FOREIGN PATENT DOCUMENTS

EP 0694 338 A2 1/1996 (EP) .
WO 95/03632 2/1998 (WO) .

* cited by examiner

*Primary Examiner*—Lee Young
(74) *Attorney, Agent, or Firm*—Venable; Norman N. Kunitz

(57) ABSTRACT

A method of producing a composite ultrasonic transducer having transducer elements comprising piezoelectric ceramic, with the elements being dispersed in plastic and radiating essentially in the longitudinal direction. To reduce production costs, in several method steps, a plurality of flat ceramic bodies (20) having a plurality of parallel, slot-like openings (21) that are closed on all sides are inserted into a casting mold (25), and the casting mold (25) is filled with plastic (26). After hardening, the resulting ingot (28) is unmolded, and, on the unmolded ingot (28), the ceramic material (26) on the end surfaces away from one another and extending transversely to the longitudinal direction of the openings (21) is removed to the point that the plastic material (26) imbedded in the openings (21) is exposed at the end surfaces (211).

16 Claims, 4 Drawing Sheets

METHOD FOR PRODUCING A COMPOSITE ULTRASONIC TRANSDUCER

REFERENCE TO RELATED APPLICATIONS

This application claims the priority of German Application Ser. No. 197 43 859.8, filed Oct. 4, 1997, which is incorporated herein by reference.

BACKGROUND OF THE INVENTION

The invention relates to a method of producing a composite ultrasonic transducer of the type which includes transducer elements that are dispersed in plastic, radiate essentially in the longitudinal direction, and comprise piezoelectric ceramic.

A composite ultrasonic transducer of this type is constructed from numerous small, piezoelectrically-active transducer elements. The dimensions of the transducer elements are conceptualized such that the elements radiate essentially in the longitudinal direction. The transducer elements of a composite ultrasonic transducer are dispersed in a plastic matrix such that their longitudinal directions are parallel. The length of the individual transducer elements determines the thickness of the composite ultrasonic transducer and thus the working-frequency range.

In a method of producing such a composite ultrasonic transducer as disclosed in EP 0 462 311 B1, first a plastic mold is created that contains negative structures corresponding to a predetermined arrangement of the transducer elements, with the mold projecting beyond the negative structures. The mold is filled with a ceramic slip to cover the negative structures, and the slip is then dried and fired. During firing, the plastic mold is burned up without solid residue, and the fixed transducer-element arrangement now appears on a ceramic base. A polymer is poured into the hollow spaces formed during firing by the burning of the plastic mold. The polymer fixes the position of the transducer elements and provides the mechanical stability of the composite ultrasonic transducer while meeting the acoustical requirements. Finally, the ceramic base connecting the transducer elements is removed, and electrodes are positioned on the end faces of the transducer elements.

In this method, for clean and loss-free unmolding of the plastic mold with the negative structures of the transducer arrangement, it is necessary to longitudinally taper the cross section of the negative structures that preset the spaces between the individual transducer elements. Consequently, only ultrasonic transducers having frustoconical or truncated-pyramidal transducer elements can be produced with this method. In addition, only limited ratios between the transducer-element geometry and the distances between the transducer elements can be realized, with the ceramic proportion being relatively small, and therefore only permitting a limited acoustical capability.

In another known method of producing composite transducers, longitudinal and transverse slots are sawed, with a highly-precise ceramic saw, preferably a circular band saw, into a ceramic block, a so-called blank, that is produced in accordance with a suitable method. The sawing cut is only deep enough that a continuous, lower ceramic base remains. The used blank is cast with a polymer, preferably polyurethane. Following the casting, the ceramic base is sawed off. The depth of the sawing cuts made in the blank is determined by the desired working frequency (resonance frequency) of the transducer.

The disadvantage of this method lies in the lengthy processing times for the sawing. Furthermore, the reject rate is very high, because some of the sawed columns break very easily due to the brittleness of the ceramic material, rendering the entire blank unusable.

It is the object of the invention to provide a method of producing a composite ultrasonic transducer that is not subject to the above limitations and, because of shorter processing times and an extremely-low reject rate, is economical.

SUMMARY OF THE INVENTION

In accordance with the invention, this object is achieved by a method of producing a composite ultrasonic transducer, which includes transducer elements that are dispersed in a plastic matrix, radiate essentially in the longitudinal direction, and comprise piezoelectric ceramic, with the method comprising the following steps:

- creating flat ceramic bodies, each of which has a plurality of spaced, slot-like openings;
- inserting a plurality of the ceramic bodies, with spacing, into a casting mold;
- filling the casting mold with a plastic material;
- hardening the plastic material and removing the resulting molded ingot from the mold; and,
- removing ceramic material present on the side surfaces of the ingot extending transversely to the longitudinal direction of the openings to the point that the plastic material imbedded in the openings is exposed at the narrow side edges of the openings.

An advantage of the method of the invention is that, unlike in the known methods, the three-dimensional transducer block is not immediately produced with the plurality of ceramic columns connected by a base; rather, ceramic bodies are first produced as a two-dimensional, ladder-like formation. These two-dimensional, ladder-like formations are assembled to form the three-dimensional transducer block. The ladder-like ceramic bodies themselves and the assembly of the ceramic bodies that is effected in the casting mold can be varied in ceramic geometry and free space corresponding to the respective requirements for the finished transducers. The ladder-like, flat ceramic bodies can be produced in accordance with known methods, preferably with pressing methods, as are known from the production of piezoceramic disks or cylinders. In contrast to the known sawing method, the processing times in the method of the invention are significantly shorter, and the reject quota is clearly lower.

Practical embodiments of the method of the invention and an advantageous modification and embodiments of the invention are disclosed.

The method of the invention is described in detail below by way of an embodiment of a composite ultrasonic transducer shown schematically in the drawings.

DETAILED DESCRIPTION OF THE PREFERRED EMBODIMENTS

Figure 1:
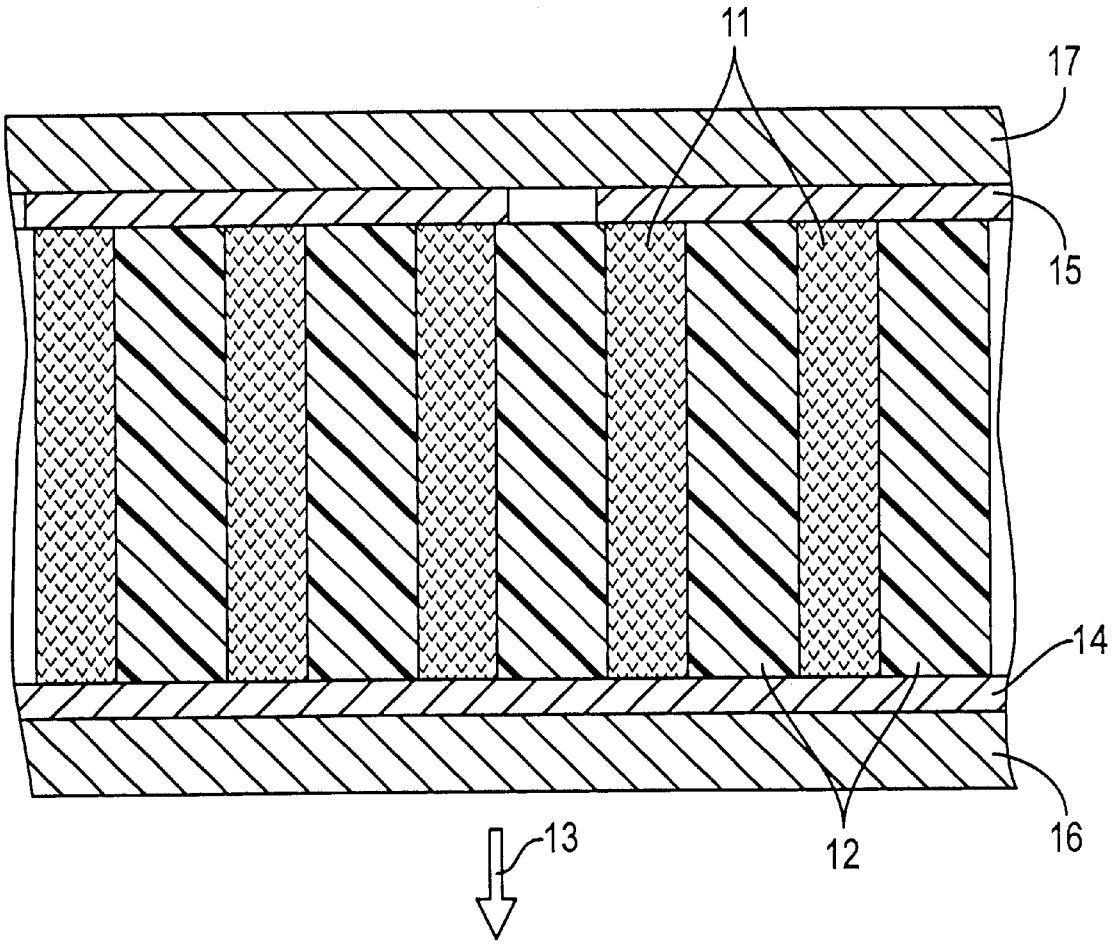
FIG. 1 is a cross-sectional view of a composite ultrasonic transducer.

The composite ultrasonic transducer shown in a cutout cross-section in FIG. 1 has a plurality of small, piezoelectrically-active transducer elements 11, which comprise piezoelectric ceramic and which are imbedded in a plastic matrix 12 made of a polymer, preferably polyurethane. Transducer elements 11 are columnar, and are oriented such that their longitudinal directions are parallel. A continuous electrode 14 is disposed on one surface of plastic matrix 12 and on one end surface of each of the transducer elements 11. A structured electrode 15 is disposed on the surface of plastic matrix 12 that faces away from continuous electrode 14, and the end surfaces of transducer elements 11. Depending on the application of the composite ultrasonic transducer, this structured electrode 15 can be structured in annular or linear fashion. With the structured electrode 15, predetermined transducer elements 11 are combined into separately-actuatable groups. Depending on which of the electrodes 14, 15 is oriented in the transmission direction, as indicated by arrow 13 in FIG. 1, at least one adaptation layer 16 is disposed, in a known manner on the one of the electrodes facing in the transmission direction, i.e., electrode 14 in the illustrated embodiment for adapting the acoustical impedance, and a damping layer 17 is disposed on the other electrode, i.e., electrode 15 in the illustrated embodiment, for absorbing ultrasound emitted counter to the transmission direction 13.

Figure 2:
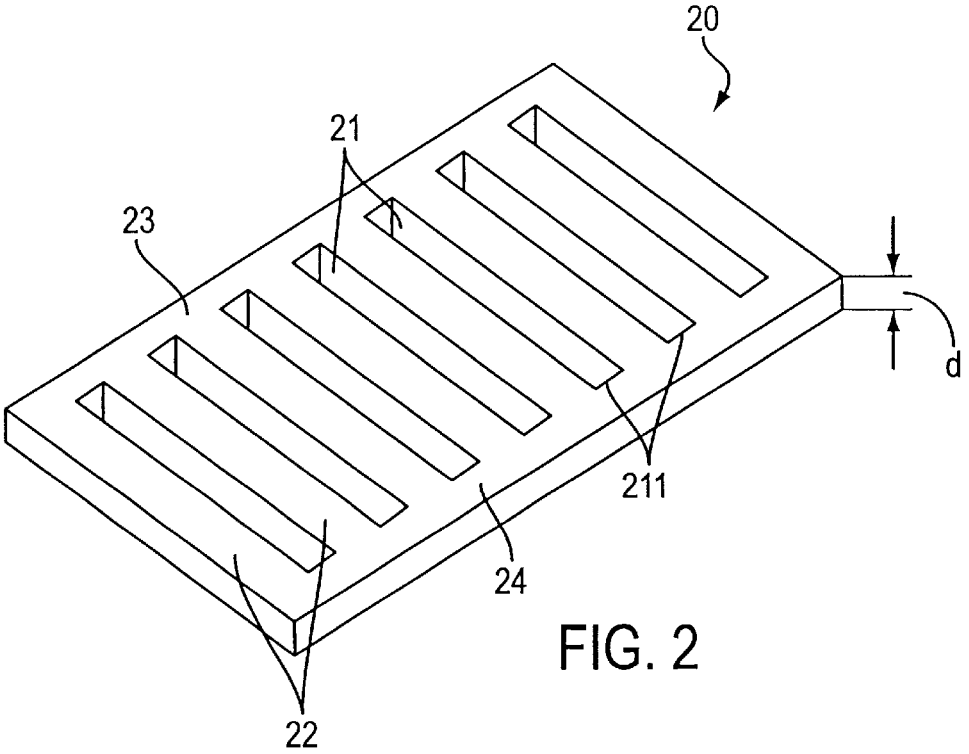
FIG. 2 is a perspective view of a ceramic body according to a first embodiment of the invention for producing the composite ultrasonic transducer of FIG. 1.

The composite ultrasonic transducer constructed in this way is produced in the following method steps:

First, a plurality of wafer-shaped ceramic bodies 20 of piezoelectric ceramic material, as illustrated in FIG. 2, are produced through pressing and subsequent firing. Ceramic body 20 is relatively thin, for example less than 0.5 mm thick. During pressing with a pressing mold, openings 21, which have a rectangular cross section with an optimized length-to-width ratio, and which are closed on all sides and extend parallel to one another, are cut into each of the ceramic bodies 20. The final product of the pressing process is a ladder-like formation of parallel ceramic ribs 22 disposed with spacing from one another corresponding to the width of openings 21. The ribs 22 are connected to one another on the respective opposite longitudinal edge surfaces of the wafer-shaped ceramic body 20 by two bridge-like ceramic strips 23 and 24, respectively. These ceramic ribs 22 later form the transducer elements 11 of the composite ultrasonic transducer in FIG. 1.

Figure 3:
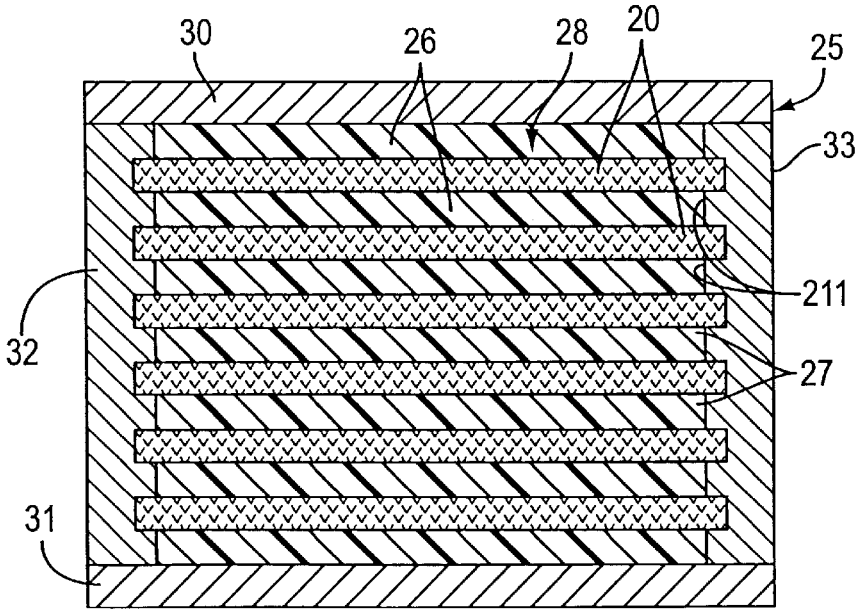
FIG. 3 is a cross-section of a casting mold filled with ceramic bodies of the type shown in FIG. 2 for producing the composite ultrasonic transducer of FIG. 1.

The ladder-like ceramic bodies 20 formed in this manner are inserted into a casting mold 25 (see FIG. 3), with the individual ceramic bodies 20 being oriented parallel to one another with spacing. FIG. 3 shows a cross-section of a casting mold 25 holding a total of six so oriented ceramic bodies 20 with the mold including top and bottom member 30, 31 and side members or spacing ribs 32, 33 for maintaining the bodies in there spaced relationship. The number of ceramic bodies 20, like the number and length of ceramic ribs 22 in the individual ceramic bodies 20, is determined by the spaced configuration of the desired composite ultrasonic transducer.

Thereafter casting mold 25 is filled with a plastic material 26 such that no air is admitted into the spaces within the mold cavity. A polymer, preferably polyurethane, is used as the plastic. This plastic material 26 fills all of the openings 21 in ceramic bodies 20, and all spaces 27 between the individual ceramic bodies 20. After the plastic material or polymer has hardened, a resulting composite cast member or molded block or ingot 28 is unmolded through the separation of casting mold 25. At the two sides of the ingot 28 facing away from one another and extending transversely to the longitudinal direction of openings 21 in the individual ceramic bodies 20, the unmolded ingot 28 is trimmed to the point that the plastic material 26 imbedded in openings 21 is exposed at the respective end surfaces. With respect to the individual ceramic bodies 20, ceramic strips 23 and 24 are removed from all ceramic bodies 20, as is the intermediate plastic material 26, through cutting or sawing along the narrow side edges 211 of openings 21. Hence, ceramic-material bridges no longer exist between ribs 22, and now the ceramic ribs 22 that form transducer elements 11 are imbedded in the plastic matrix 12. Because the rated frequency of the individual transducer elements 11 is a function of their length, the end surfaces of ceramic ribs 22 are ground off until the desired rated frequency is attained.

The final cast member, casting or ingot 28 formed in this manner is provided with electrodes 14 and 15 and layers 16 and 17, resulting in the composite ultrasonic transducer shown in FIG. 1.

The invention is not limited to the described embodiment. For example, the composite ultrasonic transducer can be embodied not only as a planar array as in FIG. 1, but also as a linear array. In this case, only a single ceramic body 20 is inserted into casting mold 25 and treated in the above-described manner.

Casting mold 25 can be embodied more simply if spacing lugs are formed onto the major surface of the two bridge-like ceramic strips 23, 24 of ceramic bodies 20. Such lugs render superfluous the spacing ribs found in the members 32 and 33 of the casting mold 25.

Figure 6:
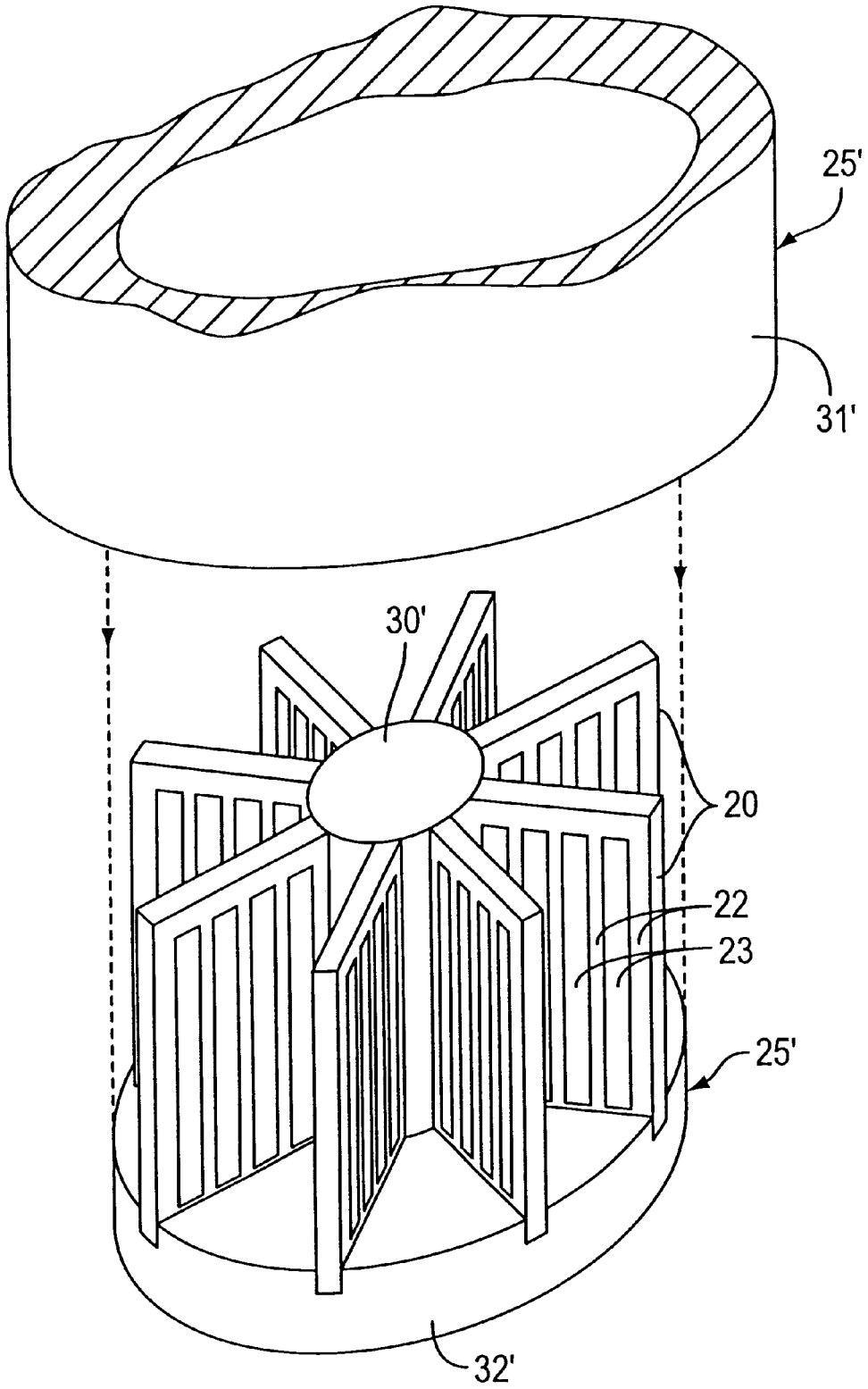
FIG. 6 is an exploded partial perspective view of a casting mold according to a modification of the invention, with the mold containing a plurality of ceramic bodies of the type shown in FIG. 2 for producing an annular composite ultrasonic transducer.

For special applications, a curved, particularly annular, casting mold can be used instead of a rectangular casting mold 25. Such an annular mold 25' is shown in FIG. 6. In the use of such a mold 25', the individual ceramic bodies 20 are inserted radially as shown. In addition, acoustically-decoupling separating layers, e.g., comprising cork or high-resistance foam, can be placed in the casting mold and cast with the other material.

Figure 4:
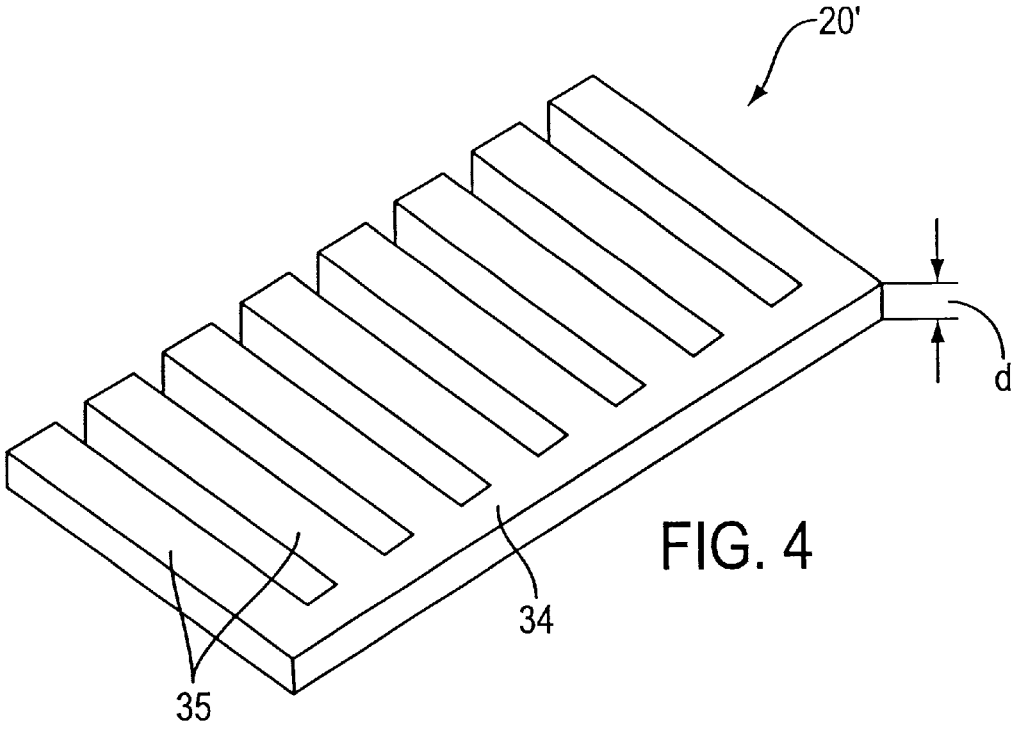
FIG. 4 is a perspective view of a ceramic body according to a second embodiment of the invention for producing the composite ultrasonic transducer of FIG. 1.
Figure 5:
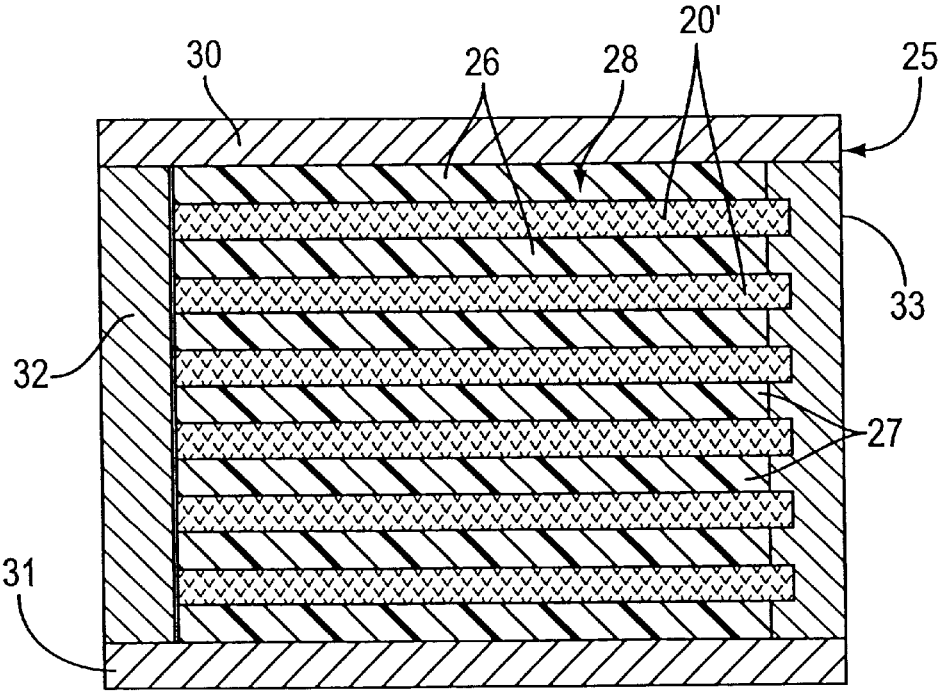
FIG. 5 is a cross-section of a casting mold filled with ceramic bodies of the type shown in FIG. 4 for producing the composite ultrasonic transducer of FIG. 1.

Instead of flat molded bodies 20 with ladder-like formations, as shown in FIG. 4, the flat molded bodies can also be produced as comb-like structures or formations 20' with comb teeth 35 projecting from a back spine portion 34 of the comb. A plurality of such comb-like structures disposed in a rectangular mold to form the transducer 11 of FIG. 1 is shown in FIG. 5. As can readily be seen and appreciated from FIG. 4 and FIG. 5, only the comb back 34 on one side of the casting or ingot 28 need be removed with this embodiment. The comb teeth 35 imbedded in the plastic matrix in turn form transducer elements 11.

The flat ceramic bodies 20 can also be produced in a way other than pressing and firing.

The invention now being fully described, it will be apparent to one of ordinary skill in the art that many changes and modifications can be made thereto without departing from the spirit or scope of the invention as set forth herein.

What is claimed is:

1. A method of producing a composite ultrasonic transducer, which includes transducer elements that are dispersed in a plastic matrix, radiate essentially in the longitudinal direction, and comprise piezoelectric ceramic material, said method comprising the following steps:

creating flat ceramic bodies, each of which has a plurality of spaced, slot-like openings;

inserting a plurality of the ceramic bodies, with spacing there-between, into a casting mold;

filling the casting mold with a plastic material;

hardening the plastic material to form a molded composite block and removing the molded composite block from the mold; and, removing ceramic material present on opposite end surfaces of the molded composite block extending transversely to the longitudinal direction of the openings to the point that the plastic material imbedded in the openings is exposed at the narrow side edges of the openings.

2. The method as defined in claim 1, wherein: the step of creating the flat ceramic bodies includes forming the bodies such that each respectively represents a ladder-like formation of two ceramic strips connected to one another by spaced ceramic ribs to thus define the openings, and the step of removing comprises removing the ceramic strips from the molded composite block removed from the mold.

3. The method as defined in claim 1, wherein the spaced slot-like openings are parallel to one another.

4. The method as defined in claim 1, wherein the step of removing ceramic material from the end surfaces includes cut ting or sawing along the narrow side edges of the openings.

5. The method as defined in claim 1, further comprising removing the end surfaces of the ceramic ribs remaining between the openings that have been filled with plastic material until a desired rated frequency of the transducer is attained.

6. The method as defined in claim 1, wherein the casting mold is rectangular, and the ceramic bodies are oriented parallel to one another in the casting mold.

7. The method as defined in claim 1, wherein the casting mold is curved in an annular fashion, and the ceramic bodies are oriented radially in the casting mold.

8. The method as defined in claim 1, further comprising placing acoustically-decoupling separating layers into the casting mold and casting same with the other materials.

9. The method as defined in claim 1, wherein the step of forming the ceramic bodies comprises pressing the ceramic material and subsequently firing same.

10. The method as defined in claim 9, wherein the ceramic bodies have a small material thickness.

11. The method as defined in claim 10, wherein the ceramic bodies have a thickness of approximately 0.5 mm.

12. The method defined in claim 10, wherein the ceramic bodies have a rectangular shape.

13. The method as defined in claim 1, wherein the plastic material is a polymer.

14. The method as defined in claim 13, wherein the polymer is polyurethane.

15. The method as defined in claim 1 further comprising the step of applying electrodes to said end surfaces of the composite block.

16. A method of producing a composite ultrasonic transducer, which includes transducer elements that are dispersed in a plastic matrix, radiate essentially in the longitudinal direction, and comprise piezoelectric ceramic material, said method comprising the following steps:

creating flat ceramic bodies, each of which has a plurality of spaced, slot-like openings;

inserting the ceramic bodies into a casting mold;

filling the casting mold with a plastic material;

hardening the plastic material and removing a resulting molded composite body from the mold;

removing ceramic material present on opposite end surfaces of the resulting molded composite body extending transversely to the longitudinal direction of the openings to the point that the plastic material imbedded in the openings is exposed at the narrow side edges of the openings; and, applying electrodes to said end surfaces of the composite body.

* * * * *